United States Patent [19]

Geenen et al.

[11] Patent Number: 4,614,893

[45] Date of Patent: Sep. 30, 1986

[54] COLOR DISPLAY TUBE

[75] Inventors: Constant J. M. Geenen; Leonardus A. M. Elshof, both of Eindhoven, Netherlands

[73] Assignee: U.S. Philips Corporation, New York, N.Y.

[21] Appl. No.: 802,080

[22] Filed: Nov. 26, 1985

Related U.S. Application Data

[63] Continuation of Ser. No. 676,222, Nov. 29, 1984, abandoned.

[30] Foreign Application Priority Data

Sep. 30, 1980 [NL] Netherlands ..... 8005409

[51] Int. Cl.[4] ..... H01J 29/81

[52] U.S. Cl. ..... 313/403

[58] Field of Search ..... 313/402, 43

[56] References Cited

U.S. PATENT DOCUMENTS

| | | | |
|---|---|---|---|
| 3,652,895 | 3/1972 | Tsuneta et al. | 313/403 |
| 3,686,525 | 8/1972 | Naruse et al. | 313/402 |
| 3,889,145 | 6/1975 | Suzuki et al. | 313/403 X |
| 3,973,159 | 8/1976 | Barten | 313/403 |
| 4,210,842 | 7/1980 | Nakayama et al. | 313/403 |

*Primary Examiner*—Palmer C. DeMeo
*Assistant Examiner*—Sandra L. O'Shea
*Attorney, Agent, or Firm*—John C. Fox

[57] ABSTRACT

A color display tube of the "in-line" type includes a shadow mask having means for producing generally elliptical equitransmission factor curves.

4 Claims, 5 Drawing Figures

65 mm : 26"
35 mm : 14"

65 mm : 26"
35 mm : 14"

COLOR DISPLAY TUBE

This is a continuation of application Ser. No. 676,222, filed Nov. 29, 1984 now abandoned.

BACKGROUND OF THE INVENTION

The invention relates to a color display tube comprising an evacuated envelope consisting of a substantially rectangular display window connected to a conical portion coupled to a neck, a display screen on the inside of the display window, which display screen comprises triplets of stripe-shaped regions which can luminesce in three colors and extend substantially perpendicularly to the long sides of the display window, and shadow mask provided in front of and parallel to the display screen. The mask comprises a metal sheet having rows of slot-shaped apertures extending substantially parallel to the stripe-shaped regions and separated from each other by ridges and elongate in the direction of the rows; one row of apertures being alotted to each triplet. The invention relates more particularly to such a display tube comprising, in addition, in the neck, and electron gun system including three electron guns which are situated with their axes in a plane extending substantially perpendicularly to the stripe-shaped regions and which serve to generate three electron beams which converge on the display screen and are deflected over the display screen and each impinges upon stripe-shaped regions of one color via the apertures in the shadow mask; said shadow mask having a non-rotationally symmetrical transmission variation proceeding from the center towards the edge.

Such a color display tube is disclosed in German Patent Application No. 27 17 441 laid open to public inspection. The shadow mask described in said patent application comprises apertures which become smaller from the center towards the edge of the shadow mask. Apertures having equal dimensions are situated on non-circular curves which are substantially rectangular with rounded corners and which follow substantially the edge of the shadow mask. The advantages of such a variation of the dimensions of the apertures in the shadow mask and, hence, of the mask transmission according to this patent application are a more uniform brightness variation which is adapted to the shape of the display screen and, in addition, an improvement of the color purity.

U.S. Pat. No. 3,686,525 discloses a color display tube having a shadow mask with rows of circular apertures situated on barrel-shaped lines in the horizontal direction and on pin-cushion-like lines in the vertical direction. According to this Patent, the dimensions of the apertures must have such a variation that a circular variation of the transmission from the center of the mask is obtained. In other words, the "equitransmission factor curves" are circles.

Nowadays, it is desired to provide display tubes with which a picture having a larger brightness can be displayed. Such display tubes as a matter of fact are used in an ambience with much ambient light. Moreover, such tubes provide a sharper picture at smaller values of the ambient light. This gain in definition is obtained because a smaller cathode current than usual is necessary to obtain the same brightness of the picture so that the diameter of the electron beam is reduced. Such display tubes can be obtained by making the mask transmission larger. The mask transmission $T_M$ is defined as the ratio between the area of an aperture and the mask surface per aperture so that it holds approximately that:

$$T_M = \frac{b.l.}{X.Y.} \cdot 100\%$$

wherein:

b is the width of the elongate aperture l is the length of the elongate aperture X is the distance between two rows of apertures, and Y is the distance between two apertures in a row.

This enlarging of the mask transmission is carried out by making all apertures in the shadow mask wider. However, this has a negative influence on the color purity or the accuracy with which the spots of the electron beams, which spots are reproductions of the apertures, coincide with the stripe-shaped regions. The value of the displacement which a spot can undergo on a stripe-shaped region without influencing the color purity is termed guard band. Guard band is necessary to compensate for displacements of the spot which are caused, for example, by differences per tube within the production tolerances or by mask displacements as a result of thermal effects.

SUMMARY OF THE INVENTION

It is the object of the present invention to provide a color display tube having larger brightness than the usual tubes, without the guard band being adversely influenced in the critical places.

Another object of the invention is to provide a color display tube having a picture whose brightness equals the usual tubes, but with a larger guard band.

A color display tube of the kind mentioned in the opening paragraph is characterized according to the invention in that places on the shadow mask having an equal transmission are situated on non-circular curves ("equitransmission factor curves") with a short main symmetry axis in said plane and a long main symmetry axis perpendicular to said plane.

The ratio between the lengths of the large and the short axes will generally be chosen to be as large as possible so that the brightness distribution of the display screen is still satisfactory. This is usually still the case when said ratio is smaller than 5.

BRIEF DESCRIPTION OF THE DRAWINGS

Embodiments of the invention and the prior art will now be described in greater detail, by way of example, with reference to the accompanying drawings, in which.

DESCRIPTION OF THE PREFERRED EMBODIMENTS

Figure 1:
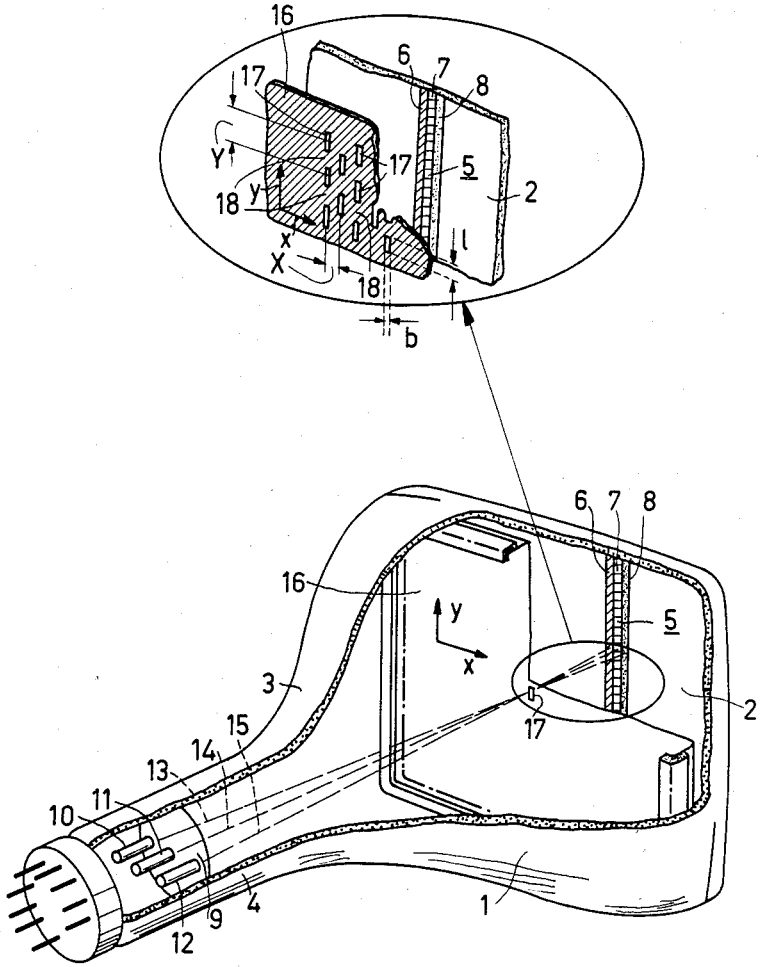
FIG. 1 is a broken-away perspective view of a color display tube according to the invention.

FIG. 1 is a perspective view of a color display tube. It comprises a glass envelope 1 consisting of a display window 2, a conical portion 3 and a neck 4. The window, conical portion and the neck are all suitably connected as is well known in the art. In the envelope, on the inside of the display window 2, a display screen 5 is provided. The screen includes a large number of triplets of stripe-shaped phosphor regions which can luminesce in three colors, namely, 6 (red), 7 (green) and 8 (blue). An "in-line" electron gun system 9 is provided in the neck 4 and comprises three electron guns 10, 11 ad 12 situated with their axes in a plane extending substantially perpendicularly to the stripe-shaped phosphor regions to generate three electron beams 13, 14 and 15. These three electron beams enclose an angle with each other so that they converge on the display screen and describe a frame of lines on the display screen as a result of deflection by a system of deflection coils (not shown). Immediately before the display screen a shadow mask 16 is provided. The mask includes a metal sheet having a number of rows of slot-shaped apertures 7 which apertures are separated in a row by ridges 18. The mask transmission is defined as $$T_M = \frac{l.b.}{X.Y.} \cdot 100\%$$

wherein l is the length of an aperture, b is the width of an aperture,

X is the distance between two successive rows of apertures in the x direction, and Y is the distance between two successive apertures in a row in the y direction.

The usual rounding-off of the ends of the elongate apertures has substantially no influence on the mask transmission so that in that case also said formula remains valid.

In the known shadow mask tubes, the variation of the transmission from the center towards the edge was circular or rectangular, for example, as disclosed in said German Patent Application No. 27 17 441. The mask transmission can be increased by making the apertures larger and hence wider. The ridges are already very narrow so making them longer cannot be done. This has for its result that the spots on the display screen become wider and the guard band decreases. A measure of the guard band δ may be defined as:

$$\delta = D - S$$

wherein D is the width of the stripe-shaped phosphor region and S is the width of the spot.

By causing, according to the invention, the mask transmission to decrease in the y-direction more slowly as compared with a circular transmission variation and causing the mask transmission in the x-direction to decrease more rapidly as compared with a circular transmission variation, from the center towards the edge of the shadow mask, a mask is obtained having a larger transmission in the central part without the guard band becoming too small in the critical places (in the corners and at the edge of the display screen), or a mask is obtained having a larger guard band in the critical places.

Figure 2:
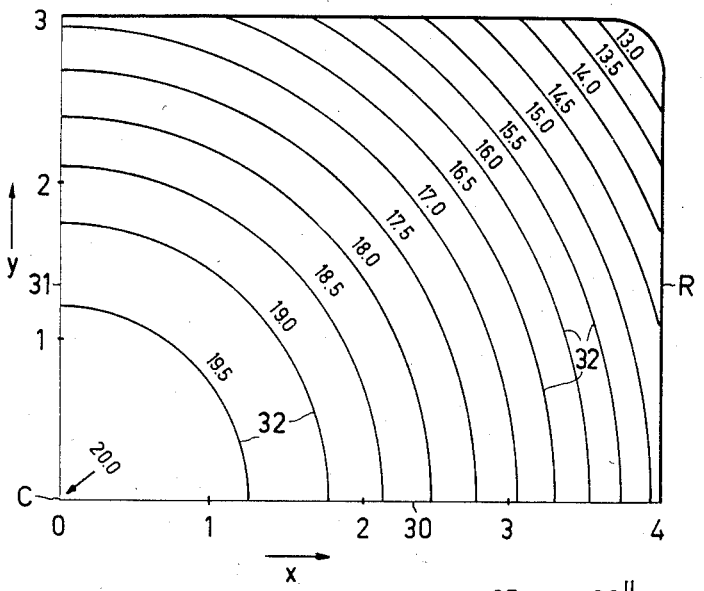
FIG. 2 shows diagrammatically a part of a shadow mask according to the prior art with a circular variation of the transmission.

FIG. 2 is a diagrammatic representation of a quarter of a prior art shadow mask of a color display tube. The mask transmission in the center C is 20%. From the center C, a horizontal x axis 30 and a vertical y-axis 31 extend. The remainder (the remaining three quarters) of the shadow mask is identical to the part shown and is symmetrical with respect to the x and y axes. In a 26" color display tube, the units in the Figure and in the following Figures in the X and Y directions are 65 mm and in a 14" color display tube, these units are 35 mm. The lines 32 on the shadow mask connect places of an equal transmission (equitransmission factor curves). In this case, the lines are circles around the center C. In the direction of the diagonal, the values of the transmission in this Figure and in the following Figures are recorded in percent belonging to the curves.

Figure 3:
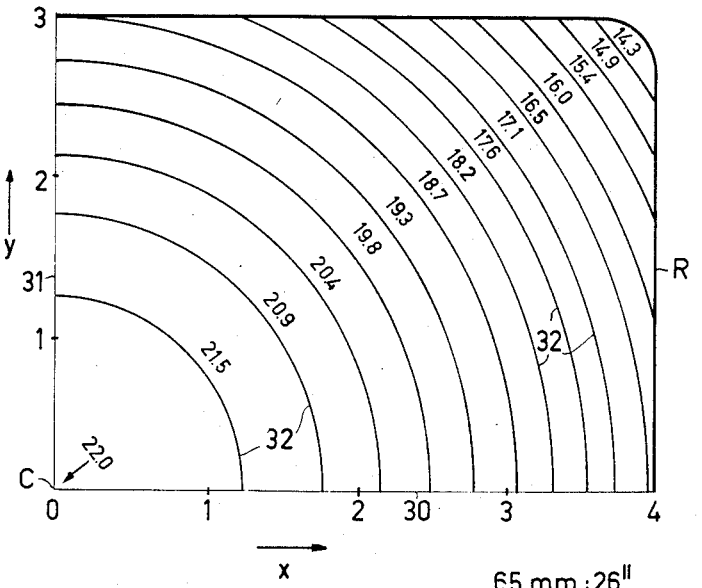
FIG. 3 shows a shadow mask according to FIG. 2 with a larger transmission.

FIG. 3 shows the shadow mask of FIG. 2 but this time with a 10% higher transmission which is obtained by making the apertures in the shadow mask wider.

Figure 4:
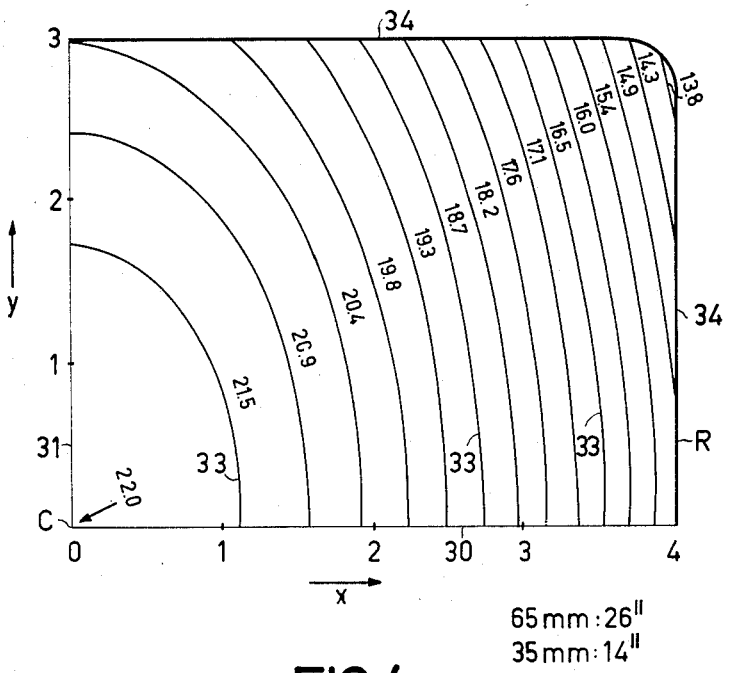
FIG. 4 shows diagrammatically a first embodiment of a part of a shadow mask or a color display tube according to the invention.

FIG. 4 shows diagrammatically a quarter of a shadow mask for a color display tube according to the invention. The mask transmission in the center C is 22%. By making, according to the invention, the variation of the transmission of the mask such that places with an equal transmission are situated on non-circular curves 33 with a short symmetry axis in the plane of the electron guns (in the X-direction 30) and a long symmetry axis perpendicular thereto (in the Y-direction 31):

(a) a color display tube is obtained which, as compared with FIG. 2, has a 10% larger brightness in the central portion of the display screen (because of the 10% larger transmission of the shadow mask in the central portion) and an approximately equal guard band at the edge R;

(b) a color display tube is obtained which, as compared with FIG. 3, has approximately the same brightness in the central portion of the display screen (both 22% transmission of the shadow mask) and a gain of guard band at the edge R.

The non-circular curves in this case are ellipses each having a long axis which is 1.55 x as long as the short axis.

Figure 5:
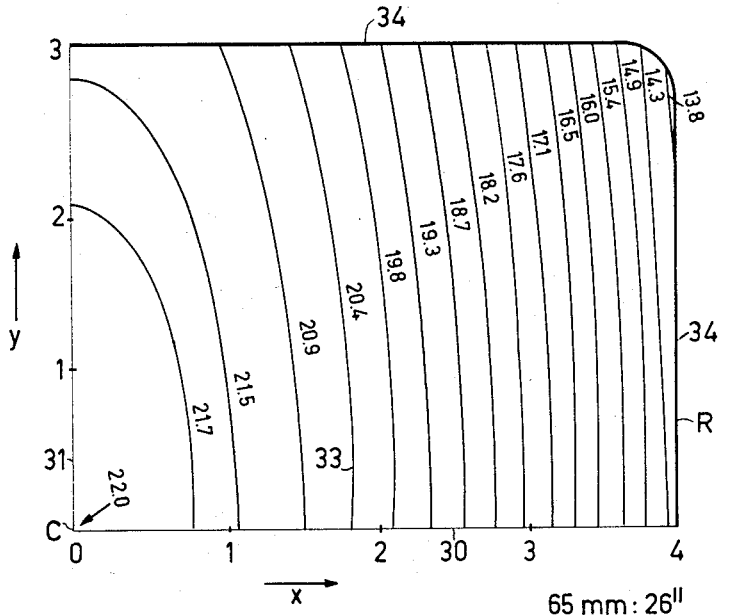
FIG. 5 shows a second embodiment analogous to FIG. 4.

In the FIG. 5 embodiment, the non-circular curves are also ellipses but in this case each has a long axis which is 2.75 x as long as the short axis.

In comparison with FIG. 2, a color display tube is obtained in this case having a 10% larger brightness in the central portion of the display screen (because of the 10% larger transmission of the shadow mask in the central portion) and in addition, a larger guard band at the edge R. This larger guard band results because the transmission and, thus, the width of the apertures at the edge R in FIG. 5 are smaller than at the same location in FIG. 1. The transmission, dependent on the width of the apertures, may in fact be considered as a measure of the guard band.

While there has been shown and described what is at present considered the preferred embodiments of a color display tube according to the invention, it will be apparent to those skilled in the art that various charges and modifications may be made therein without departing from the spirit and scope of the invention as defined by the appended claims. For example, is is not necessary for the non-circular curves produced by the shadow mask to be true ellipses. The curves may also be more or less rectangular in shape having strongly rounded off corners. In display tubes of different formats or with a less usual variation of the pitch of the apertures, the transmission variation may, of course, be chosen analogous to the two embodiments.

What is claimed is:

1. A color display tube, comprising:

an evacuated envelope including a substantially rectangular display window connected to a conical portion coupled to a neck;

a display screen on the inside of the display window, the screen comprising triplets of striped-shaped regions which can luminesce in three colors, the regions extending substantially perpendicularly to the long sides of the display window;

an electron gun system in the neck, the system having three electron guns for generating three electron beams during normal operation of the tube, the guns being situated with their longitudinal axes in a plane extending substantially perpendicularly to the stripe-shaped regions, and a shadow mask for associating each electron beam with a stripe-shaped region of one color, the mask being disposed between the display screen and the electron gun system, the mask including a metal sheet having rows of slot-shaped apertures extending substantially parallel to the stripe-shaped regions, adjacent apertures in a row being separated from one another by ridges, the apertures being elongate in the direction of the rows, one row of apertures being allotted to each triplet, characterized in that the apertures in the metal sheet are arranged and dimensioned such that places on the mask of equal electron beam transmission are situated on elliptical curves each having a short main symmetry axis in the plane and a long main symmetry axis perpendicular to the plane.

2. A color display tube as claimed in claim 1, wherein the length of each long symmetry axis is less than five times the length of a respective short symmetry axis.

3. A color display tube as claimed in claim 1, wherein the length of each long symmetry axis is 1.55 times the length of a respective short symmetry axis.

4. A color display tube as claimed in claim 1, wherein the length of each long symmetry axis is 2.75 times the length of the respective short symmetry axis.

* * * * *